US009098070B2

(12) United States Patent
Johansson

(10) Patent No.: US 9,098,070 B2
(45) Date of Patent: Aug. 4, 2015

(54) TIME COUNTER TIMEPIECE

(75) Inventor: Stefan Johansson, Sherman Oaks, CA (US)

(73) Assignee: Stefan Johansson, Sherman Oaks, CA (US)

( * ) Notice: Subject to any disclaimer, the term of this patent is extended or adjusted under 35 U.S.C. 154(b) by 0 days.

(21) Appl. No.: 14/000,148

(22) PCT Filed: Feb. 17, 2012

(86) PCT No.: PCT/US2012/025621
§ 371 (c)(1),
(2), (4) Date: Aug. 16, 2013

(87) PCT Pub. No.: WO2013/122600
PCT Pub. Date: Aug. 22, 2013

(65) Prior Publication Data

US 2013/0329530 A1 Dec. 12, 2013

Related U.S. Application Data

(60) Provisional application No. 61/444,070, filed on Feb. 17, 2011, provisional application No. 61/529,804, filed on Aug. 31, 2011.

(51) Int. Cl.
*G04F 7/08* (2006.01)
*G04C 17/00* (2006.01)

(52) U.S. Cl.
CPC ..... *G04C 17/00* (2013.01); *G04F 7/0871* (2013.01)

(58) Field of Classification Search
CPC ..... G04F 7/08
USPC ..... 368/29, 96, 101–113
See application file for complete search history.

(56) References Cited

U.S. PATENT DOCUMENTS

| | | | | |
|---|---|---|---|---|
| 4,250,572 | A * | 2/1981 | Yoshida | 368/71 |
| 4,523,857 | A * | 6/1985 | Ushikoshi | 368/157 |
| 4,537,514 | A * | 8/1985 | Moriya | 368/107 |
| 4,588,305 | A * | 5/1986 | Piguet et al. | 368/185 |
| 4,972,393 | A * | 11/1990 | Sase et al. | 368/28 |
| 5,220,541 | A * | 6/1993 | Vuilleumier | 368/88 |

(Continued)

OTHER PUBLICATIONS

International Search Report.

(Continued)

*Primary Examiner* — Amy Cohen Johnson
*Assistant Examiner* — Jason Collins
(74) *Attorney, Agent, or Firm* — Ice Miller LLP

(57) ABSTRACT

A timepiece, including a main mechanism operable to indicate time, the main mechanism positioned upon or within a face of the timepiece; a first counter including a first operation mechanism, the first counter appearing upon or within the face; a second counter including a second operation mechanism, the second counter appearing upon or within the face; and a third counter including a third operation mechanism, the third counter appearing upon or within the face. When the timepiece is in operation, the first operation mechanism, the second operation mechanism, and the third operation mechanism each have an operation status differing from one another. When the timepiece is in operation, the first operation mechanism, the second operation mechanism, and the third operation mechanism maintain a continuous time loop prior to resetting one or more of the first operation mechanism, the second operation mechanism, and/or the third operation mechanism.

22 Claims, 4 Drawing Sheets

(56) References Cited

U.S. PATENT DOCUMENTS

| | | | | |
|---|---|---|---|---|
| 6,406,176 | B1 * | 6/2002 | Takahashi et al. | 368/101 |
| 6,975,561 | B2 * | 12/2005 | Forsey et al. | 368/10 |
| 7,029,169 | B2 * | 4/2006 | Takahashi et al. | 368/106 |
| 7,522,477 | B1 | 4/2009 | Sheldon | |
| 7,778,115 | B2 * | 8/2010 | Ruchonnet | 368/11 |
| 7,905,655 | B2 * | 3/2011 | Jolidon | 368/101 |
| 2002/0006080 | A1 | 1/2002 | Shimizu et al. | |
| 2004/0037169 | A1 * | 2/2004 | Fondin et al. | 368/96 |
| 2005/0174892 | A1 | 8/2005 | Haugh | |
| 2005/0276165 | A1 | 12/2005 | Chien | |

OTHER PUBLICATIONS

Written Opinion of the International Searching Authority.

* cited by examiner

TIME COUNTER TIMEPIECE

PRIORITY

The present application is related to, claims the priority benefit of, and is a U.S. 35 U.S.C. §371 national stage entry of, International Patent Application Ser. No. PCT/U.S.2012/025621, filed Feb. 17, 2012, which is related to, and claims the priority benefit of U.S. Provisional Patent Application Ser. Nos. 61/444,070 filed Feb. 17, 2011 and 61/529,804 filed Aug. 31, 2011. The contents of each of these applications are hereby incorporated by reference in their entirety into this disclosure.

BACKGROUND

Timepieces, such as wristwatches, generally operate to maintain a time (normally a current time of day), and may include a stopwatch function. Other timepieces, such as stopwatches, generally operate as time counters, which can be set to start, stop and reset. Some timepieces utilize both functions, whereby a unitary timepiece can both maintain a time and operate as a time counter. However, such embodiments to not allow a user to have one time counter running while another time counter is stopped, so that a user of the timepiece can both count a current time and record a prior counted time.

A timepiece, allowing a user to maintain an overall continuous time loop while also concurrently operating as a time counter and providing an opportunity to record a prior counted time, in addition to maintaining a current time of day, would be well received in the marketplace.

BRIEF SUMMARY

In at least one embodiment of a timepiece of the present disclosure, the timepiece comprises a main mechanism operable to indicate time, the main mechanism positioned upon or within a face of the timepiece, a first counter comprising a first operation mechanism, the first counter appearing upon or within the face, a second counter comprising a second operation mechanism, the second counter appearing upon or within the face, and a third counter comprising a third operation mechanism, the third counter appearing upon or within the face, wherein when the timepiece is in operation, the first operation mechanism, the second operation mechanism, and the third operation mechanism each have an operation status differing from one another, and wherein when the timepiece is in operation, the first operation mechanism, the second operation mechanism, and the third operation mechanism maintain a continuous time loop prior to resetting one or more of the first operation mechanism, the second operation mechanism, and/or the third operation mechanism. In another embodiment, the timepiece comprises a wristwatch. In yet another embodiment, the timepiece comprises a handheld timer.

In at least one embodiment of a timepiece of the present disclosure, the operation status is selected from the group consisting of stop, start/operate, and reset. In an additional embodiment, when the timepiece is in operation, the first operation mechanism operates to start/operate, the second operation mechanism operates to stop in an event the second counter was previously operating to start/operate, and the third operation mechanism operates to reset in an event the third counter was previously operating to stop. In yet an additional embodiment, upon changing the operation of the timepiece a first time, the first operation mechanism operates to stop, the second operation mechanism operates to reset, and the third operation mechanism operates to reset. In another embodiment, upon changing the operation of the timepiece a second time, the first operation mechanism operates to reset, the second operation mechanism operates to start, and the third operation mechanism operates to stop.

In at least one embodiment of a timepiece of the present disclosure, the timepiece further comprises a first button operably coupled to the first operation mechanism, the second operation mechanism, and the third operation mechanism, the first button, when depressed, is operable to change the operation status. In another embodiment, the timepiece further comprises a reset button operably coupled to the first operation mechanism, the second operation mechanism, and the third operation mechanism, the reset button, when depressed, is operable to change the operation status of one or more of the first operation mechanism, the second operation mechanism, and/or the third operation mechanism to reset. In yet another embodiment, the timepiece further comprises a first button operably coupled to the first operation mechanism, the second operation mechanism, and the third operation mechanism, the first button, when depressed, is operable to change the operation status, and a reset button operably coupled to the first operation mechanism, the second operation mechanism, and the third operation mechanism, the reset button, when depressed, is operable to change the operation status of one or more of the first operation mechanism, the second operation mechanism, and/or the third operation mechanism to reset.

In at least one embodiment of a timepiece of the present disclosure, one or more of the first counter mechanism, the second counter mechanism, and/or the third counter mechanism comprises one or more hands. In an additional embodiment, one or more of the first counter mechanism, the second counter mechanism, and/or the third counter mechanism comprises an LCD screen.

In at least one embodiment of a timepiece of the present disclosure, the timepiece comprises a main mechanism operable to indicate time, the main mechanism positioned upon or within a face of the timepiece, a first counter comprising a first operation mechanism, the first counter appearing upon or within the face, a second counter comprising a second operation mechanism, the second counter appearing upon or within the face, a third counter comprising a third operation mechanism, the third counter appearing upon or within the face, a first button operably coupled to the first operation mechanism, the second operation mechanism, and the third operation mechanism, and a reset button operably coupled to the first operation mechanism, the second operation mechanism, and the third operation mechanism, wherein when the timepiece is in operation, the first operation mechanism, the second operation mechanism, and the third operation mechanism each have an operation status differing from one another, wherein when the timepiece is in operation, the first operation mechanism, the second operation mechanism, and the third operation mechanism maintain a continuous time loop prior to resetting one or more of the first operation mechanism, the second operation mechanism, and/or the third operation mechanism, wherein the first button, when depressed, is operable to change the operation status, and wherein the reset button, when depressed, is operable to change the operation status of one or more of the first operation mechanism, the second operation mechanism, and/or the third operation mechanism to reset.

In at least one embodiment of a timepiece of the present disclosure, the timepiece comprises a main mechanism operable to indicate time, the main mechanism positioned upon or within a face of the timepiece, a first counter comprising a first operation mechanism, the first counter appearing upon or within the face, and a second counter comprising a second operation mechanism, the second counter appearing upon or within the face, wherein when the timepiece is in operation, the first operation mechanism and the second operation mechanism each have an operation status differing from one another, and wherein when the timepiece is in operation, the first operation mechanism and the second operation mechanism maintain a continuous time loop prior to resetting one or more of the first operation mechanism and/or the second operation mechanism. In another embodiment, the operation status is selected from the group consisting of start/operate and stop. In yet another embodiment, when the timepiece is in operation, the first operation mechanism operates to start/operate and the second operation mechanism operates to stop in an event the second operation mechanism was previously operating to start/operate. In an additional embodiment, upon changing the operation of the timepiece a first time, the first operation mechanism operates to stop and the second operation mechanism operates start/operate. In yet an additional embodiment, upon changing the operation of the timepiece a second time, the first operation mechanism operates to reset and the second operation mechanism operates to stop. In another embodiment upon changing the operation of the timepiece a third time, the first operation mechanism operates to start/operate and the second operation mechanism operates to reset.

In at least one embodiment of a timepiece of the present disclosure, the timepiece further comprises a first button operably coupled to the first operation mechanism and the second operation mechanism, the first button, when depressed, is operable to change the operation status. In an additional embodiment, the timepiece further comprises a reset button operably coupled to the first operation mechanism and the second operation mechanism, the reset button, when depressed, is operable to change the operation status of one or more of the first operation mechanism and/or the second operation mechanism to reset. In yet an additional embodiment, the timepiece further comprises a first button operably coupled to the first operation mechanism and the second operation mechanism, the first button, when depressed, is operable to change the operation status, and a reset button operably coupled to the first operation mechanism and the second operation mechanism, the reset button, when depressed, is operable to change the operation status of one or more of the first operation mechanism and/or the second operation mechanism to reset.

In at least one embodiment of a timepiece of the present disclosure, one or more of the first operation mechanism and/or the second operation mechanism comprises one or more hands. In another embodiment one or more of the first operation mechanism and/or the second operation mechanism comprises an LCD screen.

In at least one embodiment of a timepiece of the present disclosure, the timepiece comprises a main mechanism operable to indicate time, the main mechanism positioned upon or within a face of the timepiece, a first counter comprising a first operation mechanism, the first counter appearing upon or within the face, a second counter comprising a second operation mechanism, the second counter appearing upon or within the face, a first button operably coupled to the first operation mechanism and the second operation mechanism, and a reset button operably coupled to the first operation mechanism and the second operation mechanism, wherein when the timepiece is in operation, the first operation mechanism and the second operation mechanism each have an operation status differing from one another, wherein when the timepiece is in operation, the first operation mechanism and the second operation mechanism maintain a continuous time loop prior to resetting one or more of the first operation mechanism and/or the second operation mechanism, wherein the first button, when depressed, is operable to change the operation status. In another embodiment, the reset button, when depressed, is operable to change the operation status of one or more of the first operation mechanism and/or the second operation mechanism to reset.

In at least one embodiment of a timepiece of the present disclosure, the timepiece comprises a first counter comprising a first operation mechanism, the first counter appearing upon or within the face, and a second counter comprising a second operation mechanism, the second counter appearing upon or within the face, wherein when the timepiece is in operation, the first operation mechanism and the second operation mechanism each have an operation status differing from one another, and wherein when the timepiece is in operation, the first operation mechanism and the second operation mechanism maintain a continuous time loop prior to resetting one or more of the first operation mechanism and/or the second operation mechanism.

In at least one embodiment of a timepiece of the present disclosure, the timepiece comprises a first counter comprising a first operation mechanism, the first counter appearing upon or within the face, a second counter comprising a second operation mechanism, the second counter appearing upon or within the face, and a third counter comprising a third operation mechanism, the third counter appearing upon or within the face, wherein when the timepiece is in operation, the first operation mechanism, the second operation mechanism, and the third operation mechanism each have an operation status differing from one another, and wherein when the timepiece is in operation, the first operation mechanism, the second operation mechanism, and the third operation mechanism maintain a continuous time loop prior to resetting one or more of the first operation mechanism, the second operation mechanism, and/or the third operation mechanism.

In at least one embodiment of a timepiece of the present disclosure, the first counter mechanism and the second counter mechanism each comprise at least one hand. In another embodiment, the first counter mechanism and the second counter mechanism appear upon or within the face at different locations. In yet another embodiment, the main mechanism, the first counter mechanism, and the second counter mechanism appear upon or within the face at the same location. In an additional embodiment, the main mechanism, the first counter mechanism, and the second counter mechanism share a pivot point upon or within the face. In yet an additional embodiment, the at least one hand of the first counter mechanism and the at least one hand of the second counter mechanism comprise different features selected from the group consisting of different colors, different relative widths, different relative lengths, different indicia, and different geometric configurations.

In at least one embodiment of a timepiece of the present disclosure, the first counter mechanism, the second counter mechanism, and the third counter mechanism each comprise at least one hand. In an additional embodiment, the first counter mechanism, the second counter mechanism, and the third counter mechanism appear upon or within the face at different locations. In yet an additional embodiment, the main mechanism, the first counter mechanism, the second counter mechanism, and the third counter mechanism appear upon or within the face at the same location. In another embodiment, the main mechanism, the first counter mechanism, the second counter mechanism, and the third counter mechanism share a pivot point upon or within the face. In yet another embodiment, the at least one hand of the first counter mechanism, the at least one hand of the second counter mechanism, and the at least one hand of the third counter mechanism comprise different features selected from the group consisting of different colors, different relative widths, different relative lengths, different indicia, and different geometric configurations. In another embodiment, the timepiece is further operable to display a day. In yet another embodiment, the timepiece is further operable to display a month. In an additional embodiment, the timepiece is further operable to display a year.

In at least one embodiment of a timepiece of the present disclosure, the timepiece is capable of having one or more of the time, a day, a month, and/or a year set using the first button and/or the reset button. In an additional embodiment, the timepiece further operable to set and operate an alarm. In yet an additional embodiment, the timepiece is operable using a battery. In another embodiment, the timepiece is operable by way of manual or self-winding.

BRIEF DESCRIPTION OF THE DRAWINGS

The above mentioned embodiments and other features, advantages and disclosures contained herein, and the manner of attaining them, will become apparent and the present disclosure will be better understood by reference to the following description of various exemplary embodiments of the present disclosure taken in conjunction with the accompanying drawings, wherein.

Figure 1:
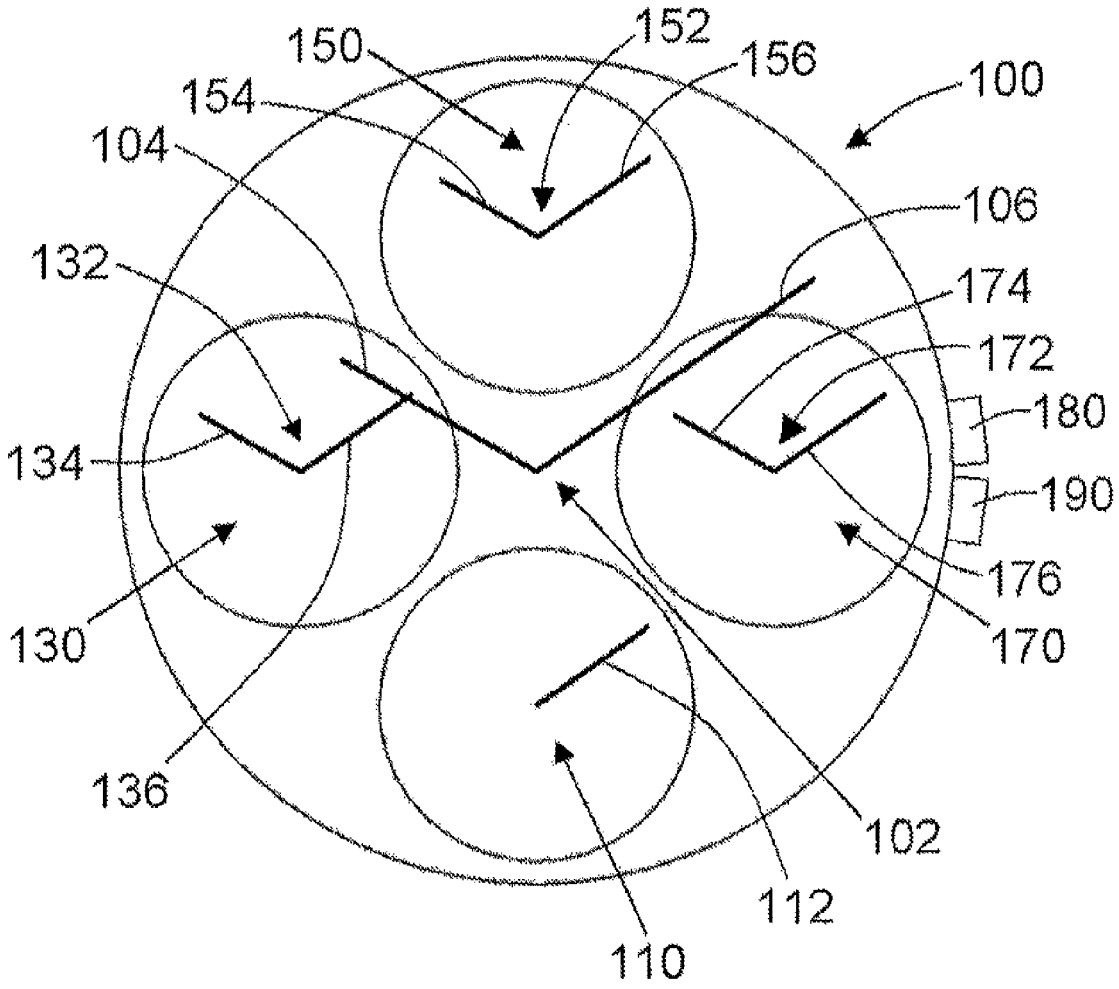
FIGS. 1-4 show exemplary embodiments of timepieces according to various embodiments of the present disclosure.

An overview of the features, functions and/or configuration of the components depicted in the various figures will now be presented. It should be appreciated that not all of the features of the components of the figures are necessarily described. Some of these non-discussed features, such as various couplers, etc., as well as discussed features are inherent from the figures. Other non-discussed features may be inherent in component geometry and/or configuration.

DETAILED DESCRIPTION

For the purposes of promoting an understanding of the principles of the present disclosure, reference will now be made to the embodiments illustrated in the drawings, and specific language will be used to describe the same. It will nevertheless be understood that no limitation of the scope of this disclosure is thereby intended.

An exemplary embodiment of a timepiece of the present disclosure is shown in FIG. 1. As shown in FIG. 1, timepiece 100 comprises a main mechanism 102. Main mechanism 102, in at least one embodiment and as shown in FIG. 1, comprises an hour hand 104 and a minute hand 106, each of which capable of movement to indicate a time of day. Main mechanism 102, in various other embodiments, may comprise only an hour hand 104 or only a minute hand 106. In addition, and in various embodiments, main mechanism 102 may further comprise a second hand 112 (as referenced below).

Timepiece 100, in at least one embodiment and as shown in FIG. 1, may further comprise a secondary mechanism 110. Secondary mechanism 110, in an exemplary embodiment, comprises, a second hand 112 capable of movement to indicate the passing of seconds or fractions thereof.

In various embodiments of timepiece 100, and as shown in FIG. 1, timepiece 100 comprises a first counter 130, a second counter 150, and a third counter 170. As shown in FIG. 1, first counter 130, second counter 150, and third counter 170 could be positioned at the relative left, top, and right of timepiece 100, in various configurations. In other embodiments, for example, first counter 130, second counter 150, and third counter 170 could be positioned at various other locations of timepiece 100, including, but not limited to, placement at or near a relative perimeter of timepiece 100 or in the relative middle of timepiece 100.

In various embodiments, first counter 130, second counter 150, and third counter 170 each comprise an operation mechanism to control the operation of said counters. For example, first counter 130 may comprise a first operation mechanism 132, second counter 150 may comprise a second operation mechanism 152, and third counter 170 may comprise a third operation mechanism 172, each of which independently controlling the operation of first counter 130, second counter 150, and third counter 170.

First operation mechanism 132 may comprise one or more hands 134, 136, second operation mechanism 152 may comprise one or more hands 154, 156, and third operation mechanism 172 may comprise one or more hands 174, 176. Each of hands 134, 136, 154, 156, 174, 176 may rotate (or count, in a digital timepiece 100 embodiment as referenced in further detail herein) to indicate passing of days, hours, minutes, seconds, or fractions thereof. In at least one embodiment, for example, hands 134, 154, and 174 measure passing of minutes (or portions thereof), and hands 136, 156, and 176 measure passing of seconds. In yet another embodiment, for example, hands 134, 154, and 174 measure passing of full seconds, and hands 136, 156, and 176 measure passing of partial seconds (such as ½, ¼, ⅕, and 1/10 of a second, for example).

In an exemplary embodiment of a timepiece 100 of the present disclosure, and whereby at least one of first counter 130, second counter 150, and third counter 170 having a moving component, each of first operation mechanism 132, second operation mechanism 152, and third operation mechanism 172 would have a separate operation status. For example, each counter 130, 150, 170 may comprise a status of "go," "stop," and "reset," at in various embodiments of timepieces 100 of the present disclosure, each counter 130, 150, 170 would at any given time have a different status from the remaining counters. An exception to the foregoing, for example, would involve an embodiment of a timepiece 100 of the present disclosure having a cumulative "reset" function, for example, as described below.

In at least one embodiment of a timepiece 100 of the present disclosure, counters 130, 150, 170 would each have a separate and distinct operation status, with at least one operation status being controlled by way of first button 180. For example, and assuming that each of counters 130, 150, 170 are not initially operating (which could occur, for example, when a timepiece 100 of the present disclosure is first being used, or whereby an embodiment of a timepiece 100 having a reset button 190 (as referenced in further detail herein) had its reset button 190 depressed to reset each counter 130, 150, 170), depressing first button 180 could cause first operation mechanism 132 of first counter 130. Depressing first button 180 again could cause first operation mechanism 132 to stop, and could cause second operation mechanism 152 of second counter 150 to start. Depressing first button 180 yet again could then cause first operation mechanism 132 to reset first counter 130 (setting first counter 132 to a relative zero), could cause second operation mechanism 152 to stop, and could cause third operation mechanism 172 of third counter to start. Continuing this process, depressing first button 180 once more could cause third operation mechanism 172 to stop, cause first operation mechanism 132 to start, and cause second operation mechanism 152 to reset. Depressing first button 180 yet again could cause first operation mechanism 132 to stop, cause second operation mechanism 152 to start, and cause third operation mechanism 172 to reset. This process would continue to repeat itself as first button 180 is depressed, and would end when reset button 190 is depressed, for example.

Operation of an exemplary timepiece 100 of the present disclosure, as detailed above, can be depicted in the following manner:

TABLE 1

| Assuming initial start with all zeros | | | | | |
|---|---|---|---|---|---|
| | First push | Second Push | Third Push | Fourth Push | Fifth Push |
| First Operation Mechanism 132 | start | stop | reset | start | stop |
| Second Operation Mechanism 152 | nothing | start | stop | reset | start |
| Third Operation Mechanism 172 | nothing | nothing | start | stop | reset |

In an embodiment of an exemplary timepiece of 100 of the present disclosure having a reset button 190, as referenced herein, operation of timepiece 100 could operate in the following manner:

TABLE 2

| Starting with reset, then pushing of button 180 | | | | | |
|---|---|---|---|---|---|
| | Reset all | First push | Second Push | Third Push | Fourth Push |
| First Operation Mechanism 132 | reset | start | stop | reset | start |
| Second Operation Mechanism 152 | reset | nothing | start | stop | reset |
| Third Operation Mechanism 172 | reset | nothing | nothing | start | stop |

The disclosure of the present application is not limited to the foregoing operations. However, and as shown above, various timepieces 100 of the present disclosure having such an operation maintain a continuous loop of time until, for example, reset button 190 is pressed. As shown in Table 1, for example, the first push causes first operation mechanism 132 to start/operate, the second push causes second operation mechanism 152 to start/operate, the third push causes third operation mechanism to start/operate, and the fourth push causes first operation mechanism 132 to start/operate once again, noting the various pushes also have the effect of stopping and/or resetting one or more mechanisms 132, 152, and 172, as appropriate. This process would also continue to repeat itself as first button 180 is depressed, and would end when reset button 190 is depressed, for example.

This operation, allowing a continuous loop to occur, allows a user of timepiece 100 to not only record discreet time measurements (such as the amount of time to run a lap, for example), but also to maintain time for a second lap while offering the user the opportunity to write down the time for the first lap, for example.

In at least one embodiment of a timepiece 100 of the present disclosure, timepiece 100 comprises a first counter 130 having a first operation mechanism 132, and a second counter 150 having a second operation mechanism 152. An exemplary embodiment, upon depressing first button 180, may operate in the following manner:

TABLE 3

| Assuming initial start with all zeros | | | | | |
|---|---|---|---|---|---|
| | First push | Second Push | Third Push | Fourth Push | Fifth Push |
| First Operation Mechanism 132 | start | stop | reset | start | stop |
| Second Operation Mechanism 152 | nothing | start | stop | reset | start |

In an embodiment of an exemplary timepiece of 100 of the present disclosure having a first counter 130, a second counter 150, and reset button 190, as referenced herein, operation of timepiece 100 could operate in the following manner:

TABLE 4

| Starting with reset, then pushing of button 180 | | | | | |
|---|---|---|---|---|---|
| | Reset all | First push | Second Push | Third Push | Fourth Push |
| First Operation Mechanism 132 | reset | start | stop | reset | start |
| Second Operation Mechanism 152 | reset | nothing | start | stop | reset |

Figure 2:
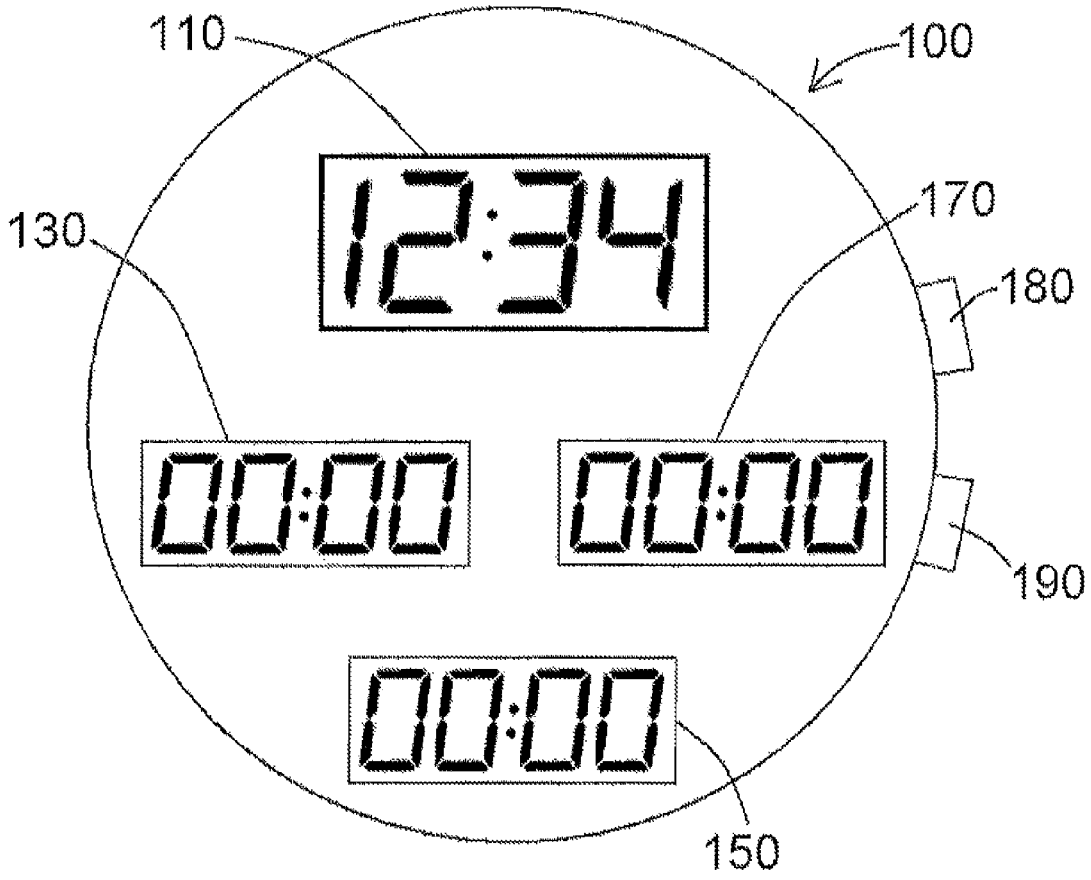

In at least one additional embodiment of a timepiece 100 of the present disclosure, timepiece 100 comprises digital mechanisms/counters as shown in FIG. 2. For example, and in at least one embodiment, one or more of main mechanism 102, secondary mechanism 110, first counter 130, second counter 150, and third counter 170 are digital mechanisms/counters (such as liquid crystal display (LCD) screens, for example), as opposed to traditional "analog" mechanisms/counters involving the movement of one or more hands. Said counters/mechanisms may operate to keep traditional time as well as stopwatch time as generally referenced herein.

Figure 3B:
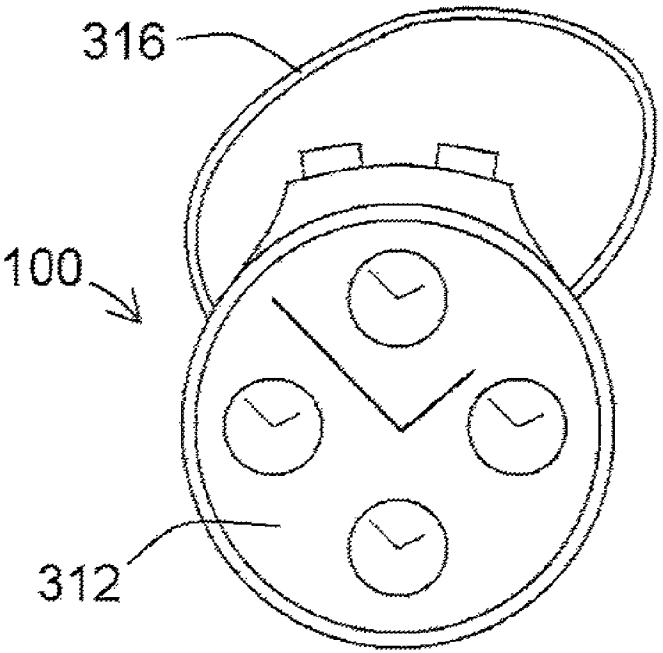
Figure 3A:
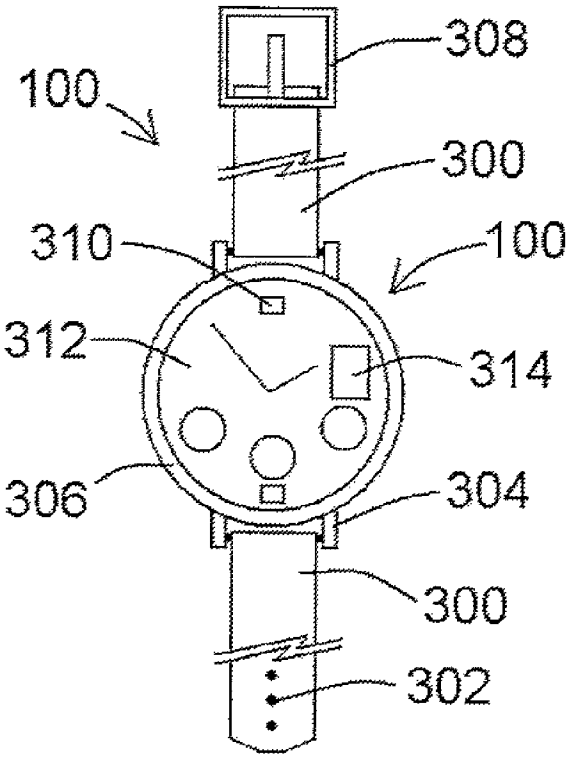

Various timepieces 100 of the present disclosure may comprises different styles of wristwatches. Said wristwatches (exemplary timepieces 100), as well as other embodiments of timepieces such as stopwatches, for example, may comprise any number of additional components/features as known in the art and as shown in FIGS. 3A and 3B, such as one or more watch bands 300 (defining one or more apertures 302, for example), arms 304 (to support watch bands 300) extending from or as part of watch frame 306, and clasps 308, and may have one or more indicia 310 (such as numbers, logos, letters/words, dashes, etc.) either presented upon watch face 312, or appearing through an aperture 314 defined within watch face 312. Additional embodiments may comprise one or more bands 316 useful to, for example, keep an exemplary timepiece 100 of the present disclosure secured around a user's hand or neck.

Figure 4:
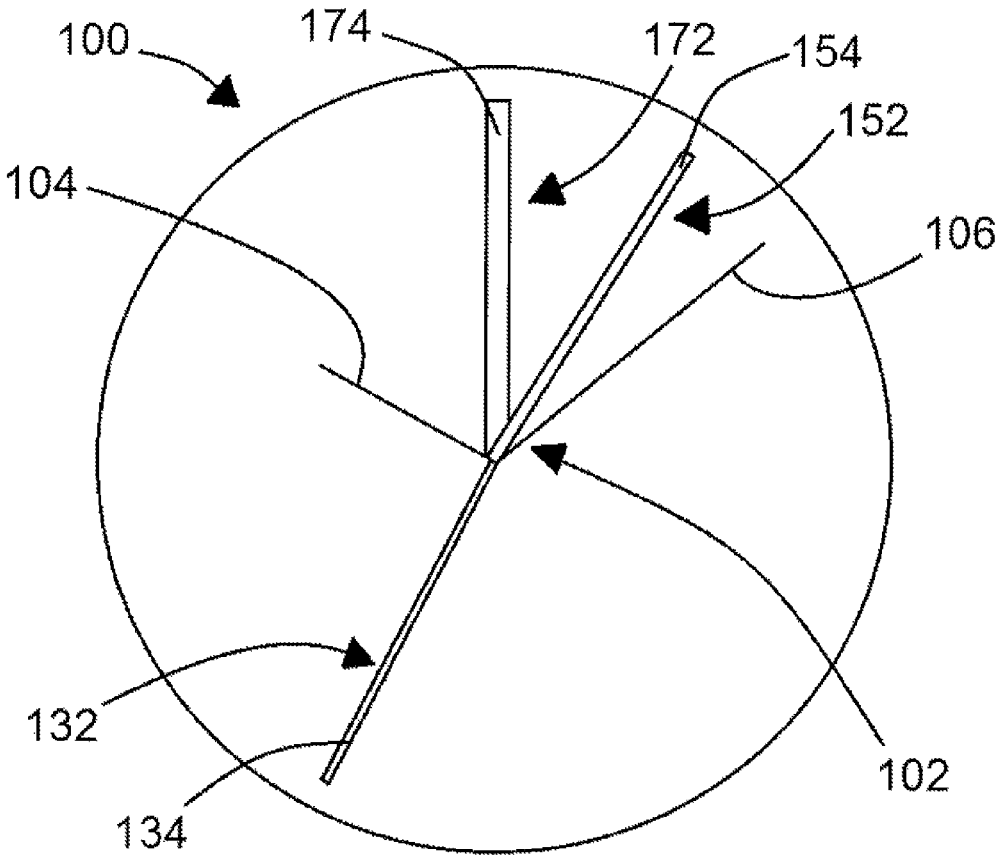

At least another embodiment of an exemplary timepiece 100 of the present disclosure is shown in FIG. 4. As shown in FIG. 4, an exemplary timepiece 100 comprises a main mechanism 102 having an hour hand 104 and a minute hand 106, and further comprises a first operation mechanism 132, a second operation mechanism 152, and a third operation mechanism 172 (of a first counter 130, a second counter 150, and a third counter 170, respectively). In the exemplary timepiece embodiment shown in FIG. 4, first operation mechanism 132 comprises a hand 134, second operation mechanism 152 comprises a hand 154, and third operation mechanism 172 comprises a hand 174. Each of hands 134, 154, 174, as referenced herein, may rotate (or count, in a digital timepiece 100 embodiment as referenced in further detail herein) to indicate passing of days, hours, minutes, seconds, or fractions thereof.

In various embodiments, hands 134, 154, 174 comprise some sort of feature to differentiate one from the other. For example, and in at least one embodiment, hands 134, 154, 174 may have different colors, have different indicia, have different lengths, widths, and/or other configurations, and/or a combination of the same. For example, and in one embodiment, a first hand may be red, a second hand may be blue, and a third hand may be green.

In such an exemplary embodiment of a timepiece 100 of the present disclosure, and whereby at least one of first counter 130, second counter 150, and third counter 170 has a moving component (such as hands 134, 154, 174, for example), each of first operation mechanism 132, second operation mechanism 152, and third operation mechanism 172 would have a separate operation status. For example, and as referenced above for various other timepiece 100 embodiments, each counter 130, 150, 170 may comprise a status of "go," "stop," and "reset," at in various embodiments of timepieces 100 of the present disclosure, each counter 130, 150, 170 would at any given time have a different status from the remaining counters. An exception to the foregoing, for example, would involve an embodiment of a timepiece 100 of the present disclosure having a cumulative "reset" function, for example, as described above.

Furthermore, various other components, such as batteries, winding mechanisms, etc., may be used in connection with various timepiece 100 embodiments. Various timepieces 100 of the present disclosure may comprise any number of suitable materials, including metal, plastic, glass, crystal, and/or wood.

While various embodiments of timepieces and methods for using the same have been described in considerable detail herein, the embodiments are merely offered by way of non-limiting examples of the disclosure described herein. It will therefore be understood that various changes and modifications may be made, and equivalents may be substituted for elements thereof, without departing from the scope of the disclosure. Indeed, this disclosure is not intended to be exhaustive or to limit the scope of the disclosure.

Further, in describing representative embodiments, the disclosure may have presented a method and/or process as a particular sequence of steps. However, to the extent that the method or process does not rely on the particular order of steps set forth herein, the method or process should not be limited to the particular sequence of steps described. Other sequences of steps may be possible. Therefore, the particular order of the steps disclosed herein should not be construed as limitations of the present disclosure. In addition, disclosure directed to a method and/or process should not be limited to the performance of their steps in the order written. Such sequences may be varied and still remain within the scope of the present disclosure.

I claim:

1. A timepiece, comprising:

a main mechanism operable to indicate time, the main mechanism positioned upon or within a face of the timepiece;

a first counter comprising a first operation mechanism, the first counter appearing upon or within the face; and a second counter comprising a second operation mechanism, the second counter appearing upon or within the face;

a third counter comprising a third operation mechanism, the third counter appearing upon or within the face;

wherein when the timepiece is in operation, the first operation mechanism, the second operation mechanism, and the third operation mechanism each have an operation status differing from one another, wherein the operation status is selected from the group consisting of start/operate, stop, and reset; and wherein when the timepiece is in operation, one of the first operation mechanism, the second operation mechanism, or the third operation mechanism maintain a continuous time loop prior to resetting one or more of the first operation mechanism, the second operation mechanism, and/or the third operation mechanism.

2. The timepiece of claim 1, wherein the timepiece comprises a wristwatch.

3. The timepiece of claim 1, wherein the timepiece comprises a handheld timer.

4. The timepiece of claim 1, wherein when the timepiece is in operation, the first operation mechanism operates to start/operate, the second operation mechanism operates to stop in an event the second operation mechanism was previously operating to start/operate, and the third operation mechanism operates to reset in the event that the third counter was previously operating to stop.

5. The timepiece of claim 4, wherein upon a first change in the operation status of the timepiece by a user, the first operation mechanism operates to stop, the second operation mechanism operates start/operate, and the third operation mechanism operates to reset.

6. The timepiece of claim 5, wherein upon a second change in the operation status of the timepiece by the user, the first operation mechanism operates to reset, the second operation mechanism operates to stop, and the third operation mechanism operates to start/operate.

7. The timepiece of claim 6, wherein upon a third change in the operation status of the timepiece by the user, the first operation mechanism operates to start/operate, the second operation mechanism operates to reset, and the third operation mechanism operates to stop.

8. The timepiece of claim 1, wherein one or more of the main mechanism, the first operation mechanism, the second operation mechanism, and/or the third operation mechanism comprises one or more hands.

9. The timepiece of claim 8, wherein the main mechanism, the first counter mechanism, and the second counter mechanism, and the third counter mechanism appear upon or within the face at the same location.

10. The timepiece of claim 9, wherein the main mechanism, the first counter mechanism, the second counter mechanism, and the third counter mechanism share a pivot point upon or within the face.

11. The timepiece of claim 8, wherein the at least one hand of the first counter mechanism, the at least one hand of the second counter mechanism, and the at least one hand of the third counter mechanism comprise different features selected from the group consisting of different colors, different relative widths, different relative lengths, different indicia, and different geometric configurations.

12. The timepiece of claim 1, wherein one or more of the main mechanism, the first operation mechanism, the second operation mechanism, and/or the third operation mechanism comprises an LCD screen.

13. The timepiece of claim 1, wherein the first counter mechanism, the second counter mechanism, and the third counter mechanism appear upon or within the face at different locations.

14. The timepiece of claim 1, wherein the timepiece is further operable to display a day.

15. The timepiece of claim 14, wherein the timepiece is further operable to display a month.

16. The timepiece of claim 15, wherein the timepiece is further operable to display a year.

17. The timepiece of claim 1, wherein the timepiece further operable to set and operate an alarm.

18. The timepiece of claim 1, wherein the timepiece is operable using a battery.

19. The timepiece of claim 1, wherein the timepiece is operable by way of manual or self-winding.

20. A timepiece, comprising:

a main mechanism operable to indicate time, the main mechanism positioned upon or within a face of the timepiece;

a secondary mechanism operable to indicate time, the secondary mechanism positioned upon or within a face of the time piece;

a first counter comprising a first operation mechanism, the first counter appearing upon or within the face;

a second counter comprising a second operation mechanism, the second counter appearing upon or within the face; and a third counter comprising a third operation mechanism, the third counter appearing upon or within the face;

wherein when the timepiece is in operation, the first operation mechanism, the second operation mechanism, and the third operation mechanism each have an operation status differing from one another, wherein the operation status is selected from the group consisting of start/operate, stop, and reset; and wherein when the timepiece is in operation, one of the first operation mechanism, the second operation mechanism, or the third operation mechanism maintain a continuous time loop prior to resetting one or more of the first operation mechanism, the second operation mechanism, and/or the third operation mechanism.

21. The timepiece of claim 20, wherein the secondary mechanism is further operable to display seconds or fractions thereof.

22. The timepiece of claim 20, wherein the secondary mechanism, the first counter mechanism, the second counter mechanism, and the third counter mechanism appear upon or within the face at different locations.

* * * * *